US009371652B2

(12) United States Patent
Malott

(10) Patent No.: US 9,371,652 B2
(45) Date of Patent: Jun. 21, 2016

(54) SHIFTING ROLL AWNING WITH DRIVE MECHANISM

(71) Applicant: Dometic Corporation, Louisville, KY (US)

(72) Inventor: Dale Malott, Middlebury, IN (US)

(73) Assignee: Dometic Corporation, Louisville, KY (US)

( * ) Notice: Subject to any disclaimer, the term of this patent is extended or adjusted under 35 U.S.C. 154(b) by 207 days.

(21) Appl. No.: 13/907,220

(22) Filed: May 31, 2013

(65) Prior Publication Data

US 2014/0352893 A1 Dec. 4, 2014

(51) Int. Cl.
*E04F 10/06* (2006.01)
*E06B 9/92* (2006.01)

(52) U.S. Cl.
CPC ..... *E04F 10/0625* (2013.01); *E06B 9/92* (2013.01)

(58) Field of Classification Search
CPC .. E04F 10/0648; E04F 10/0655; F16C 11/06; F16D 3/40; F16D 3/38
USPC ..... 160/66–68, 309, 310; 403/57
See application file for complete search history.

(56) References Cited

U.S. PATENT DOCUMENTS

| | | | | | |
|---|---|---|---|---|---|
| 642,423 | A | * | 1/1900 | Brodie | 160/120 |
| 1,652,566 | A | * | 12/1927 | Emig | 160/72 |
| 3,446,263 | A | * | 5/1969 | Roth | 160/120 |
| RE30,664 | E | | 7/1981 | Upton et al. | |
| 4,456,049 | A | | 6/1984 | Vecchiarelli | |
| 4,862,940 | A | * | 9/1989 | Atchison | 160/67 |
| 4,997,021 | A | | 3/1991 | Brutsaert | |
| 5,232,036 | A | | 8/1993 | Brutsaert | |
| 5,597,006 | A | * | 1/1997 | Simonetti | B60P 3/343 135/88.01 |
| 5,673,739 | A | | 10/1997 | Brutsaert | |
| 5,732,756 | A | | 3/1998 | Malott | |
| 5,813,424 | A | | 9/1998 | Simonetti | |
| 5,819,830 | A | | 10/1998 | Verelst | |
| 5,823,216 | A | | 10/1998 | Simonetti | |
| 5,845,695 | A | | 12/1998 | Cadorette et al. | |
| 5,860,440 | A | | 1/1999 | Murray et al. | |
| 6,086,133 | A | * | 7/2000 | Alonso | 296/97.8 |
| 6,287,206 | B1 | * | 9/2001 | Stage | 464/119 |
| 6,341,638 | B1 | | 1/2002 | Thompson et al. | |
| RE37,567 | E | | 3/2002 | Murray | |
| 6,782,936 | B1 | | 8/2004 | Girard et al. | |
| 6,971,433 | B2 | | 12/2005 | Wagner et al. | |
| 7,140,598 | B2 | | 11/2006 | Verakis et al. | |
| 7,604,036 | B2 | | 10/2009 | Thompson et al. | |
| 2005/0039861 | A1 | | 2/2005 | Faludy et al. | |

(Continued)

FOREIGN PATENT DOCUMENTS

JP 2007285112 11/2007

OTHER PUBLICATIONS

International Search Report and Written Opinion of PCT Serial No. PCT/US2014/040300 Sep. 24, 2014.

*Primary Examiner* — Syed A Islam
*Assistant Examiner* — Jeremy Ramsey
(74) *Attorney, Agent, or Firm* — Middleton Reutlinger

(57) ABSTRACT

Various embodiments of a shifting awning roll with drive mechanism are taught wherein the drive mechanism may be utilized in manual or automated modes to extend or retract the awning. Additionally, the awning uses a lighter weight design than prior art awnings and further operates with the drive to tolerate axial misalignment during extension, retraction or height adjustment.

21 Claims, 6 Drawing Sheets

(56) References Cited

U.S. PATENT DOCUMENTS

2009/0050277 A1* 2/2009 Ito ..... 160/67
2010/0258252 A1 10/2010 Brutsaert
2010/0263808 A1 10/2010 Hanley et al.
2012/0273141 A1 11/2012 Miller et al.
2012/0273142 A1* 11/2012 Miller et al. ..... 160/309

* cited by examiner

SHIFTING ROLL AWNING WITH DRIVE MECHANISM

STATEMENT REGARDING FEDERALLY SPONSORED RESEARCH

None.

REFERENCE TO SEQUENTIAL LISTING, ETC.

None.

CLAIM TO PRIORITY

None.

BACKGROUND

1. Field of the Invention

Present embodiments relate to awnings for use with recreational and sport vehicles, including but not limited to RVs and boats or other structures, mobile or fixed, which may utilize an awning assembly. More specifically, present embodiments are related to shifting roll awnings with drive mechanisms which are utilized to actuate the at least one awning assembly between extended and retracted positions.

2. Description of the Related Art

There are various types of retractable awning assemblies that are mounted to recreational vehicles, sport vehicles, including watercrafts, and buildings. These awnings provide a sheltered area which is shaded or protected from rain or UV exposure and an additional outdoor living space which is especially desirable for people who utilize recreational vehicles regularly and who enjoy the use of outdoor patios.

The awning assemblies typically have structures which are mounted to the wall of the RV or building structure. Awning assemblies typically have a roller assembly which is retracted when the awning is not in use and which is extended when the awning is utilized to provide a shaded, sheltered area. These awnings generally utilize either a manual system to extend or retract, or an automated system.

In the development and manufacture of awnings, there is a desire to eliminate the number of steps needed for installation of the awning. There is additionally a desire to eliminate the torsion spring from the roller, in part, due to the difficulties in installations. More specifically, there is a difficulty in securing the end assemblies against rotation during the installation process and in further part reducing weight of the assembly. Another goal is to reduce steps to deploy and stow the awning. A still further goal is to eliminate any roller tube locking step requiring a customer to lock or unlock an awning. Finally, another goal for awning development and manufacture allows adaptation from manual to automated operation with an electric drive, for example, while also simplifying the task of stowage when winds are moving the awning.

Accordingly there is a need to overcome these and other deficiencies while meeting at least the desired goals associated therewith.

SUMMARY

According to some embodiments, a shifting roll awning assembly comprises a roller tube having a first end and a second end, the roller tube having a canopy rolled thereon, a joint connected to a drive shaft at one of the first end and the second end, a drive assembly operably connected to the drive shaft at the other of the first end and the second end, the drive assembly providing for input at a first angle and output at a second angle, and, a receiver operably connected to an input of the drive assembly. The shifting roll awning assembly wherein the joint is a universal joint. The shifting roll awning assembly wherein the joint allows off angle operation between the shaft and the drive assembly. The shifting roll awning assembly wherein the drive assembly is a gear drive. The drive assembly may be a right angle gear drive. The drive assembly may be a flexible shaft. The input of the drive assembly may be one of manual or automated. The shifting roll awning assembly wherein the joint includes at least one pad. The shifting roll awning assembly wherein the receiver is a cone shaped receiver. The shifting roll awning assembly further comprising an input drive which engages said cone shaped receiver. The shifting roll awning assembly wherein the input drive is T-shaped. The shifting roll awning assembly wherein the input drive has a shear pin. The shifting roll awning assembly further comprising a cover for the drive shaft.

According to other embodiments, a shifting roll awning assembly comprises a roller of generally cylindrical shape having a first end and a second end, one of the first and second ends having a first end cap and a journaled shaft extending through the end cap for operable connection to a bracket, the other of the first and second ends of the roller having a second end cap and gimbal extending from the second end cap, a joint connected to the gimbal and to a drive shaft, a drive connected to the drive shaft and turning the shaft. The shifting roll awning assembly wherein the drive has an input oriented in a first direction and an output oriented in a second direction. The shifting roll awning assembly wherein the drive is a right angle drive. The shifting roll awning assembly wherein the drive shaft passes through the bracket. The joint may be a universal joint. The universal joint may have pads disposed between gimbals and a linkage. The drive has a receiver. The receiver is at least one of cone shaped or bell shaped. The shifting roll awning assembly wherein the receiver receives one of a manual input or an automated input.

According to still other embodiments, a shifting roll awning assembly comprises a roller having a generally cylindrical shape with a first end and a second end, a drive located at one of the first end and the second end, the drive receiving a drive shaft which causes rotation of the roller, the roller having an end cap adjacent to the drive and connected to the drive shaft by a universal joint, a receiver connected to the drive. The shifting roll awning assembly wherein the drive receives a drive input. The shifting roll awning assembly wherein the drive input has a shear pin. The shifting roll awning assembly further comprising a cover disposed over said drive shaft.

BRIEF DESCRIPTION OF THE DRAWINGS

In order that the embodiments may be better understood, embodiments of shifting roll awning with drive mechanism will now be described by way of examples. These embodiments are not to limit the scope of the claims as other embodiments of the shifting roll awning with drive mechanism will become apparent to one having ordinary skill in the art upon reading the instant description. Non-limiting examples of the present embodiments are shown in figures wherein:

DETAILED DESCRIPTION

Figure 1:
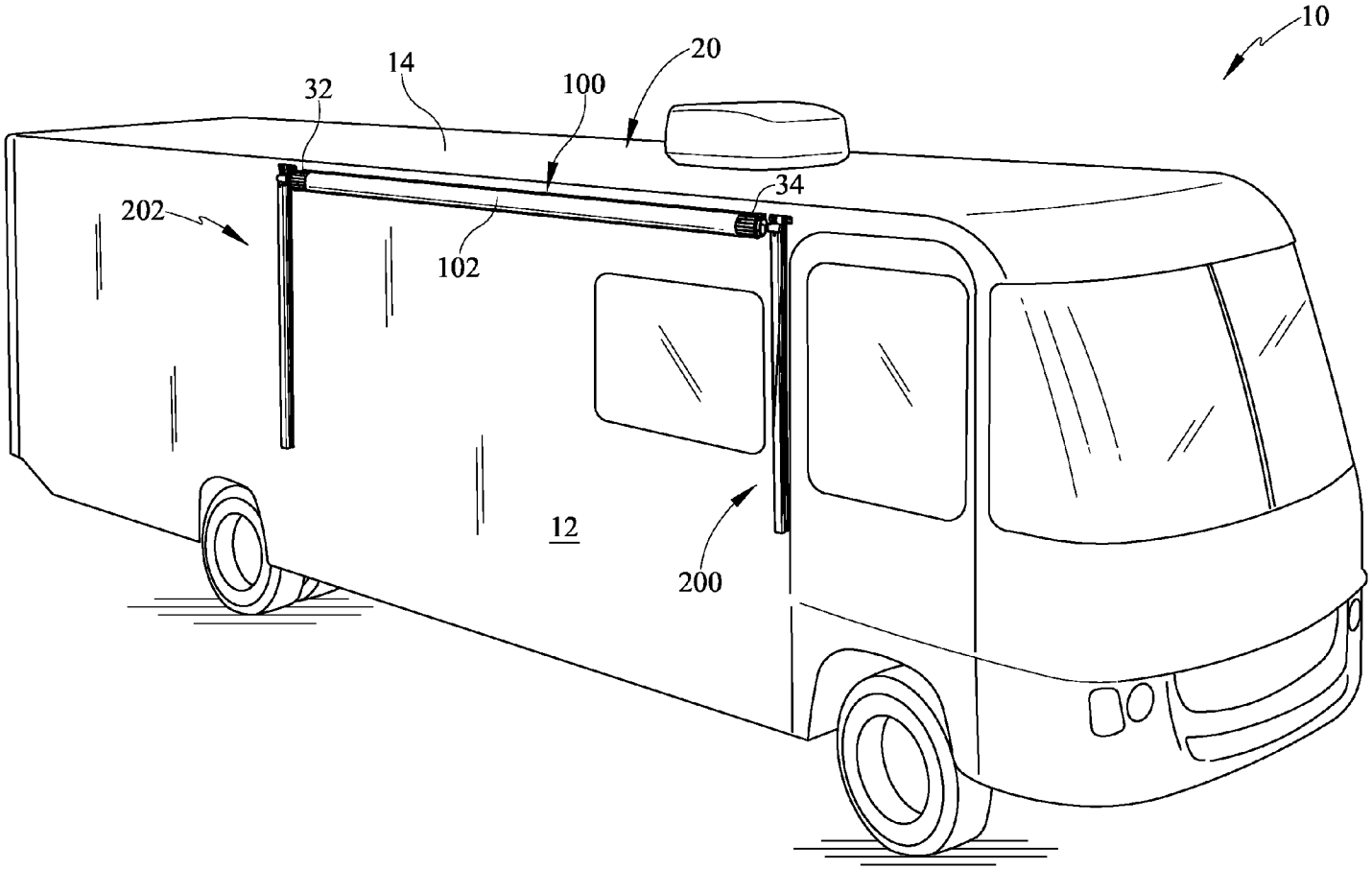
FIG. 1 is a perspective view of an exemplary embodiment of a shifting roll awning with drive mechanism disposed in a retracted position and mounted on an exemplary recreational vehicle.

It is to be understood that the shifting roll awning with drive mechanism is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numeral indicate like elements throughout several views, there are shown in FIGS. 1 through 6 various embodiments of a shifting awning roll with drive mechanism. The drive mechanism may be utilized in manual or automated modes to extend or retract the awning. Additionally, the awning uses a lighter weight design than prior art awnings and further operates with the drive to tolerate axial misalignment during extension, retraction or height adjustment.

Referring now to FIG. 1, a perspective view of a recreational vehicle ("RV") 10 is depicted. The RV 10 includes an engine and transmission, not shown, as well as at least one sidewall 12 and a roof 14. Additionally, the RV may be in the form of a non-powered, pull-behind camper. While the term RV is utilized, the term is meant is a broader sense to include boats or other marine applications which for example use canopy or awning structures such as commercial vehicles, agricultural vehicles, horse trailers, and temporary structures such as those used at sports events for tailgating and flea markets or any stationary or moving structure which may utilize a canopy. In summary, it should be clear to one skilled in the art that the shifting roll awning with drive mechanism may be utilized with both moving vehicles as well as stationary structures.

A shifting roll awning with drive mechanism 20 is connected to one of the sidewall 12 or the roof 14 of the vehicle 10. In further embodiments, the awning assembly 20 mounted on the roof, may be recessed, or may be retractable within the sidewall so as to reduce the airflow interference of the assembly while the vehicle 10 is being operated. Additionally, cassette style awnings and stationary awnings may be utilized with present embodiments and therefore should be considered within the scope of the present claims.

Figure 2:
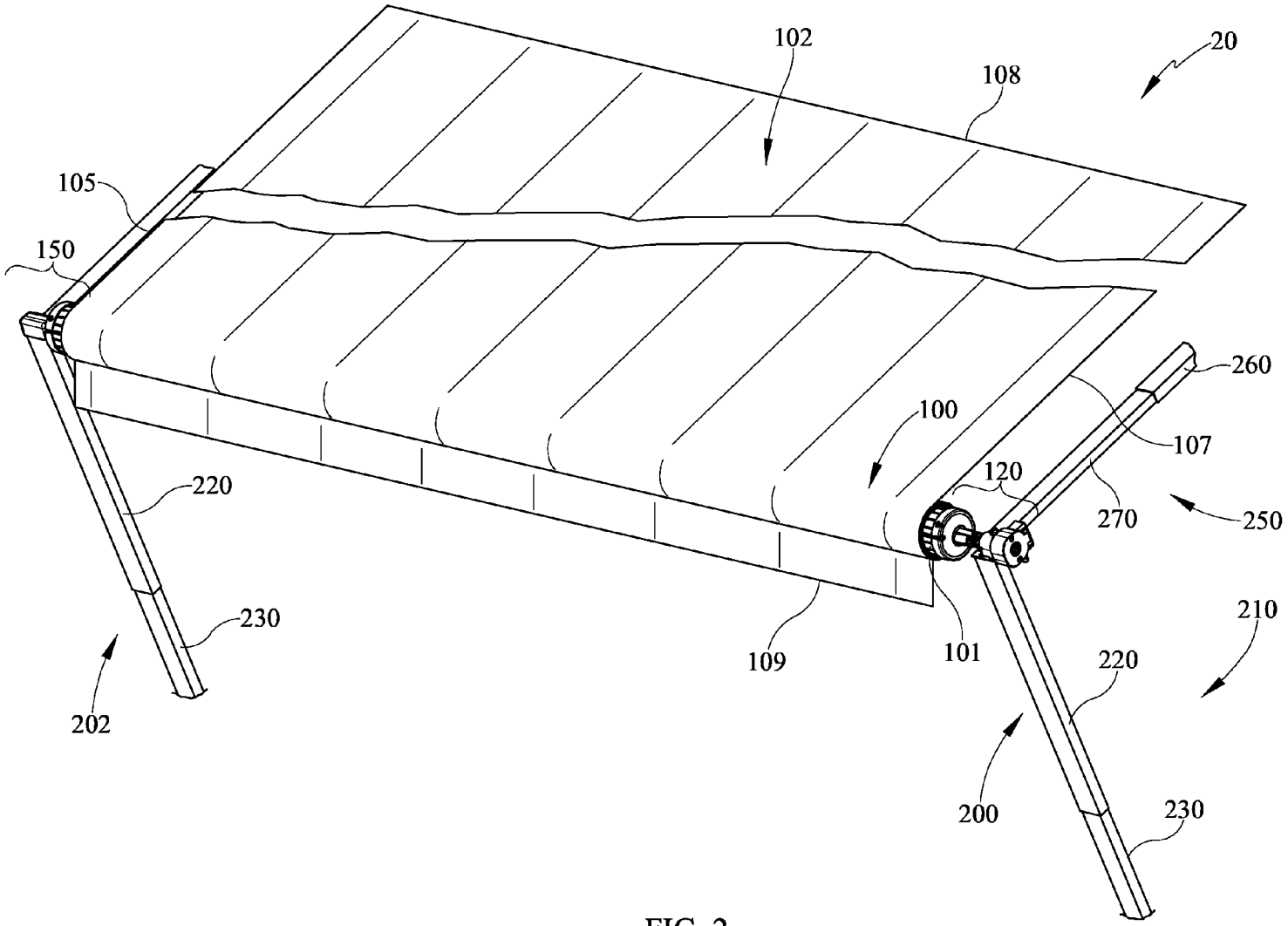
FIG. 2 is a perspective view of an exemplary shifting roller awning with drive mechanism in an extended position.

The shifting roll awning with drive mechanism 20 includes a fabric roller tube assembly 100 and opposed hardware arm assemblies 200, 202. An awning or canopy 102 is shown in a retracted position wrapped about the fabric roller tube assembly 100. The fabric roller tube assembly 100 is connected at ends to at least one first hardware arm assembly 200 and at least one second hardware arm assembly 202. The awning or canopy 102 includes a first side edge 105 (FIG. 2), a second side edge 107 (FIG. 2), a first inner edge 108 (FIG. 2) and a second outer edge 109 (FIG. 2). The canopy 102 is exemplary and other variations may be utilized. The fabric roller tube assembly 100 may be formed of various materials including metallic materials such as aluminum or other lightweight materials, and may additionally be extruded, for example. The materials may be painted or coated to provide an aesthetically pleasing appearance and resilience to environmental deterioration. The fabric may comprise various materials known to those skilled in the art.

Referring now to FIGS. 1 and 2, the roller assembly 100 is shown in a retracted position (FIG. 1) for when the vehicle is in motion or shade is not needed and in an extended position (FIG. 2) wherein the assembly 100 moves inwardly and outwardly corresponding to retraction or extension of the canopy 102 to provide the sheltered or shaded area beneath the canopy 102. The roller assembly 100 may be a manual assembly requiring manual rotation to extend or retract the canopy 102. Alternatively the roller assembly 100 may be an automated system such as by electrical, air, hydraulic or other fluid power systems to cause extension or retraction of the canopy 102. The awning assembly 100 further comprises an awning rail assembly (not shown) which may connect the awning assembly 100 and the hardware assemblies 200, 202 to the sidewall 12 of the vehicle.

Referring now to FIG. 2, a perspective view of the shifting roll awning with drive mechanism is depicted in an extended position and removed from the RV 10. The shifting roll awning with drive mechanism 20 includes the fabric roller tube assembly 100 and the first and second hardware arm assemblies 200, 202 located at ends of the roller tube assembly 100. The fabric roller tube assembly 100 is wrapped with a fabric canopy 102. The canopy is shown extended from the inner edge 108 to the outer edge 109 and between sides 105 and 107. The roller tube 101 has an axial length which is greater than the distance between edges 105 and 107. In the depicted embodiment, the tube 101 is generally hollow and the canopy 102 wraps about the outer surface of the tube. However, this is not limiting as other embodiments may be utilized wherein the canopy 102 passes into the roller tube in a retracted condition.

The hardware arm assemblies 200, 202 are now described, with specific reference to assembly 200, which is more clearly shown but is generally the same hardware arm assembly 202. The hardware arm 200 comprises a first support arm assembly 210 including a first portion 220 which is slidably connected to a second portion 230. In the instant embodiment, for example, the first portion 220 slidably receives the second portion 230. However, it should be understood that various hardware assembly embodiments may be utilized and the depicted structure should not be considered limiting. In the retracted position of FIG. 1, the arm portion 220 defines an outer structure which receives the inner portion 230. Similarly, the second arm assembly or rafter assembly 250 includes a first arm portion 260 and a second arm portion 270 which is slidable relative to portion 260. At the rafter assembly 250, the first or inner rafter portion 260 slidably receives the second or outer rafter portion 270 when the roller tube assembly 100 is retracted. The first and second ends of said rafter assembly 250 are attached respectively to the mounting structure at the roller tube assembly 100 by the installer, and to the wall 12 of the vehicle 10 or stationary structure. Similarly, the first and second ends of the first arm assembly 210 are respectively attached to the roller tube assembly 100 and the wall 12, for example by mounting structure. Ends of said arm assemblies 210, 250 are attached to roller tube assembly 100 at end cap assemblies 120, 150. The assemblies 210, 250 of the hardware assembly 200 operate in concert to support ends of the roller tube assembly 100 in both the retracted position and in the extended position. Similar function occurs at the opposite end of the roller tube assembly 100 with hardware assembly 202.

Figure 3:
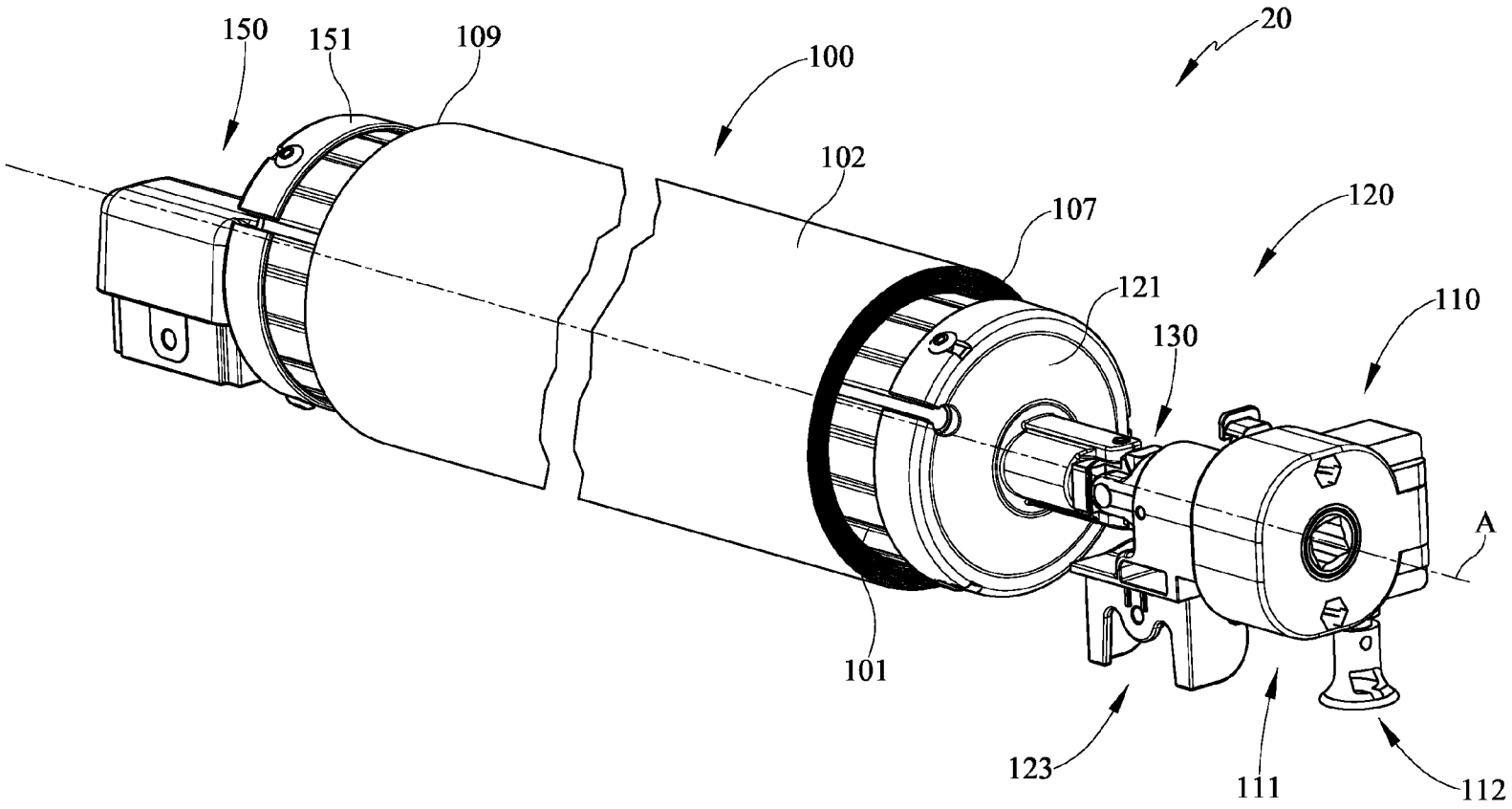
FIG. 3 is a perspective view of the embodiment of FIG. 2 in the retracted position.

Referring now to FIG. 3, a perspective view of the shifting roll awning with drive mechanism 20 is depicted. The roller tube assembly 100 includes a roller tube 101 having end cap assemblies 120 and 150 to connect and support the roller tube assembly 100 with the hardware arm assemblies 200, 202 (FIG. 2). Extending through the roller tube assembly 100, the roller tube 101 is a cylindrical structure having a plurality of grooves extending axially along the outer circumferential surface. The tube 101 is generally hollow. At ends of the tube 101 are end caps 121, 151. The end cap 151 is journaled to allow rotation of the tube 101. The end cap 121 is fixed to the tube 101 and relative to a shaft connected to joint 130. This allows rotational input at a drive mechanism 110. The roller tube assemblies include the end cap assemblies 120, 150. The end cap assembly 120 further comprises the drive mechanism 110, including a transmission 111, and a joint 130 which are operably connected to the roller tube 101.

The end cap assembly 120 also includes a bracket 123 disposed between the transmission 111 and the joint 130. According to one embodiment, the bracket 123 is cast part or casting however the bracket 123 may take various forms. The bracket 123 is attached to the upper end of the arm assembly 210 (FIG. 2), and more specifically, to the arm portion 220 (FIG. 2) with fasteners by the installer. The bracket 123 in the embodiment depicted in FIG. 3 orbits a shaft 122 (FIG. 4) connected to the joint 130 and the transmission 111 allowing the bracket to accommodate movement of the tube assembly 100 by the hardware arm assemblies 200, 202. Additionally, the shaft 122 may rotate within the bracket 123 regardless of the angular position of the bracket 123. However, according to some embodiments, the bracket may be limited in movement relative to the shaft 122. For example, according to some embodiments, the relative movement may be limited to 45 degrees and in other embodiments the relative movement may be limited to 30 degrees. These however are non-limiting examples. Both the orbit of the bracket 123 and the rotation of the shaft 122 are described as relative to an axis A extending through the roller tube 101, the joint 130 and the transmission 111. This attachment is via the shaft geometry on its interior end and via a clip 129 (FIG.4), for example a c-clip installed in an annular groove on the outer end of the shaft 122 to prevent axial movement. The shaft 122 and bracket 123 have holes that can be aligned and fixed against rotation with a pin should the need arise to remove the drive mechanism 110 for service or replacement, or for any other need.

Figure 4:
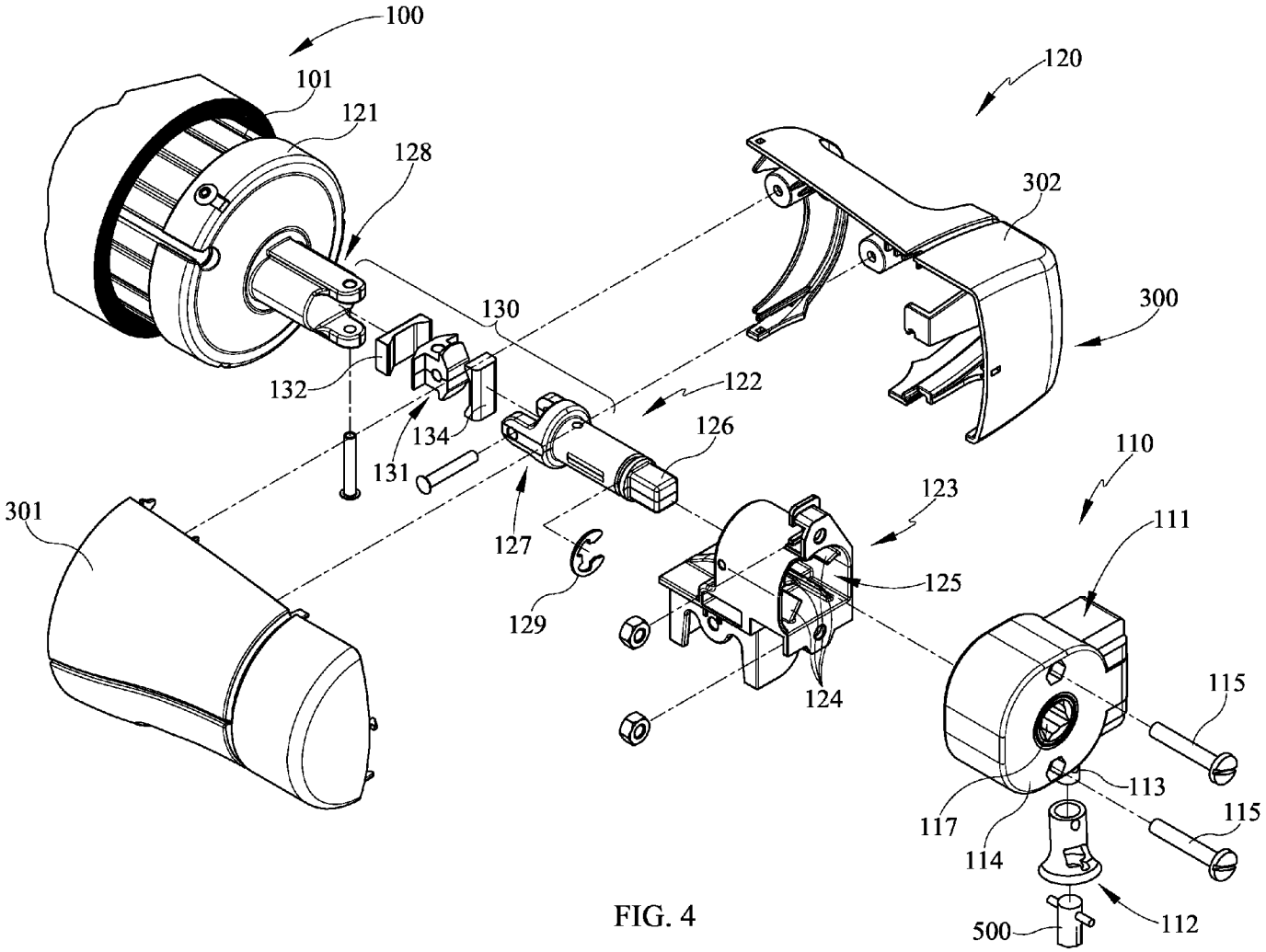
FIG. 4 is an upper exploded perspective view of the end cap assembly including drive mechanism.
Figure 5:
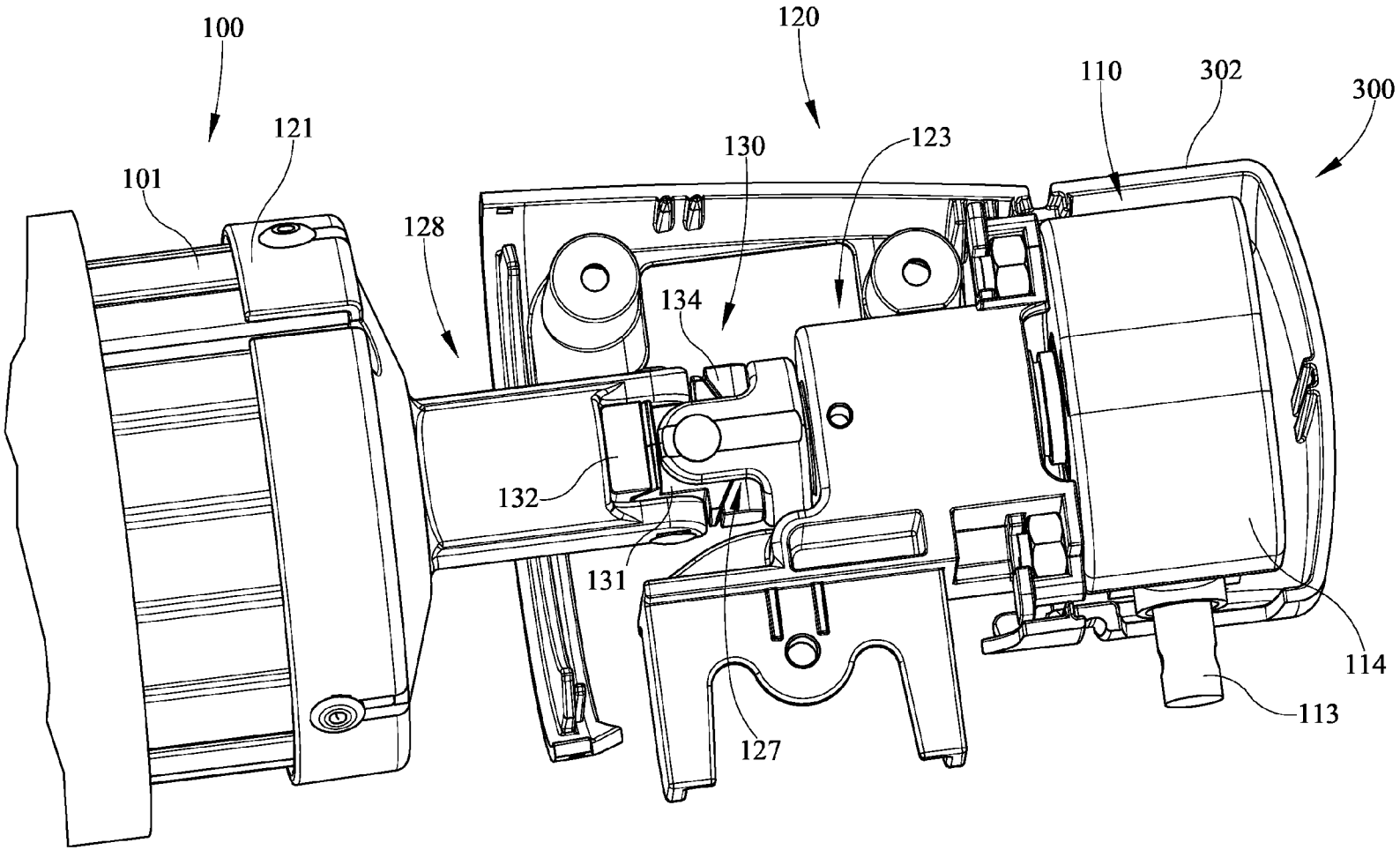
FIG. 5 is an upper perspective view of the partially assembled end cap assembly of FIG. 4; and, FIG. 6 is a perspective view of an opposite end cap assembly of FIG. 5.

Referring now to FIGS. 4 and 5, exploded and assembled views of the end cap assembly 120 are depicted. At the outer most end of the assembly 120, farthest from the roller 101, is the drive mechanism or assembly 110 including the transmission 111. The transmission 111 includes a housing 114 which encloses a transmission structure, for example which may be a plurality of gears. According to the instant embodiment, the transmission receives an input from a first direction and provides an output in a second direction. In some embodiments the transmission may comprise a right angle drive. Other drives may be utilized which are linear in nature or are at some angle other than ninety degrees. According to alternative embodiments, a flexible shaft may be utilized instead of gears. These examples are non-limiting.

The transmission 111 of some embodiments utilizes a right angle drive to accommodate an input location directed downward. This provides easy access to a user for manual or automated input driving torque. For example, in some embodiments, a tool may be used to manually input driving torque to the transmission 111. According to other embodiments, an input driving torque may be provided through the use of an automated drill, which may be electric, air or hydraulically powered for example.

Depending from the housing 114 is a receiver 112 which is operably connected to an input of the transmission 111 through the housing 114. According to some embodiments, the receiver 112 is secured to the transmission 111 with one or more fasteners 115. The receiver 112 of some embodiments may be bell shaped, cone shaped or any shape having a larger input (lower) end than upper end to easily accept the manual or automated torque input tool and guide the tool by narrowing size to an interface for inputting the torque to the transmission 111. For example, a manual torque input device, such a pole, or an automated torque input device such as a drill with a head to match the input shape of the transmission 111 may both be utilized. The funnel shape receiver 112 may be used in lieu of larger eyelets as an input structure for various reasons. For example, the receiver 112 may reduce the overall diameter of a shipping tube that the full fabric roller tube assembly will fit within. Additionally, the receiver 112 may also facilitate receipt of an input drive 500 (FIG. 4), guiding the 'T' end of the input drive 500 while the cone 112 'T' shape additionally facilitates retainment of the input drive 500 in the cone 112 during deployment and stowage. According to the depicted embodiment, the T-shape is partially defined by a shear pin which protects the transmission or cone from damage.

According to some embodiments, the receiver 112 generally funnels to a 'T' shaped receiver opening to accept a 'T' shaped drive mechanism (drive) 500. The combined shapes of the cone's 112 receiver funnel and "T" allow a 12 degree misalignment of the axis of the input drive 500 to the axis of the cone 112. This value is exemplary as other tolerance angle amounts may be designed and utilized. Additionally, the embodiment described is merely one example and the arrangement may be reversed or alternate embodiments may be utilized. For example, the 'T' shaped mechanism may be placed on the awning assembly and the cone 112 may be disposed on the driver shaft, which may be manual or automated.

The drive mechanism 110 is connected by fasteners 115 to the bracket 123. An interior 125 of the bracket 123 includes a plurality of ribs 124 which extend inwardly from the inner surface of the bracket 123 toward the center of the bracket 123. The ribs 124 are spaced apart toward the central portion of the bracket interior 125. The spacing allows for insertion of shaft 122 through the bracket 123 in order to engage the drive mechanism 110. The ribs 124 provide rotational support for the shaft 122 within the bracket 123.

The shaft 122 has a first end 126 and a second end 127. The first end 126 is shaped to mate with the drive mechanism 110. In the instant embodiment, the shape of end 126 is square in cross-section. As shown in viewing the drive mechanism 110, the central shaft opening has a mating square shape. However, alternate geometries may be utilized for the transmission opening 117. Further, keys and keyways may also be utilized to engage the shaft 122 and the drive mechanism 110.

The joint 130 is defined in part by a gimbal 127 at an opposite end of shaft 122. The gimbal 127 allows one degree of freedom about an axis, for example a generally horizontal axis in the position depicted. At the opposite end of the joint 130 is an end cap gimbal 128. This end cap gimbal 128 allows for a second degree of freedom which is perpendicular to the degree of freedom of the first gimbal 127. The end cap gimbal 128 is fixedly connected to the end cap 121 so that rotation of the gimbal 128 causes rotation of cap 121 and tube 101.

The gimbals 127 and 128 are joined by linkage 131. The linkage 131 allows for connection of the gimbals to rotate about differing axes while the end cap gimbal 128 and shaft 122 rotate and are driven by input torque through the transmission 111. The joint linkage 131 of the exemplary embodiment comprises two passages in offset parallel planes, wherein the passages are generally perpendicular in orientation to each other if the planes are coplanar. This joint 130 allows for misalignment between the roller tube assembly 100 and the drive mechanism 110 while also allowing for the rotational torque transfer through the drive mechanism 110 and the joint 130 to the roller tube assembly 100. According to one embodiment, the joint 130 is a universal joint.

The joint 130 attaches the end cap 121 and the shaft 122 and allows rotation about aforementioned passage axes without allowing axial translation. This joint 130 allows rotation of the end cap 121 and roller 101 about the roller 101 axis A (FIG. 3) when then end cap 121 and shaft 122 are not coaxial. It also allows the axis of the roller tube 101 and the center axis of the drive mechanism 110 to be non-axially aligned while still allowing raising of either arm assembly 210, 250 (FIG. 2) to adjust the height of the roll tube ends deployed, regardless of the orientation of the pin securing the end cap 121 to the drive mechanism 110.

The joint 130 further comprises a plurality of pads 132, 134. The pads 132, 134 engage the gimbals 128, 127 on one side and the linkage 131. The pads 132 and 134 of the exemplary embodiments are formed of stiff elastomeric, for example hard rubber material, between the joint 130 and both the end cap 121 and the shaft 122. The pads 132, 134 limit the amount of axial misalignment between the tube 101 and the drive mechanism 110 axes during operation when the weight of the awning, or wind or other loading is resisting movement. This resistance to misalignment (twisting) is beneficial as operational torque increases with misalignment of the two axes, and reduction of twisting provides better appearance and customer perception as well as potentially reducing possibility of damage to other awning components or to the joint itself. These pads 132, 134 are captivated by the mating parts geometry but could alternately be molded to the universal assembly with or without geometry constraints. Other joints that provide similar function are known in general in the mechanical arts and could be employed in place of this embodiment.

Surrounding the outside of the structure is a cover 300. The cover 300 is split in two sections to provide an aesthetically pleasing appearance. The cover 300 also provides a guard function for moving parts inhibits touching or tangling of anything with the rotating joint and shaft structures therein. The current embodiment end cap assembly 120 is structural in appearance and comprises a front 301 and back 302 that can be snapped together or secured in any other manner to each other and secured to or just captivating one or more of the components that are covered.

The geometry of the end assembly 120, joint 130 and end cap 121 are such that a 30 degree tilt is provided for between the tube 101 axis and the drive mechanism 110 axis without interference of parts. This is exemplary however as various angles of misalignment may be designed for. This 30 degree tilt allows for no interference on an eight feet (8') long awning but geometries could be modified to increase the misalignment allowance to suit shorter awnings, or to reduce gaps between parts on longer awnings that do not experience as significant of a tilt during operation. The material of the cover 300 is rigid plastic but could alternately be a pliable material in one piece and deform for assembly over the mating components. Alternately, end cap assembly 120 geometry could be made aesthetically pleasing to avoid use of special covers.

Although the present embodiments depict awning arm assemblies of one exemplary type, it should be understood by one skilled in the art that alternate arm assemblies are well within the scope of the instant embodiments. For example, cassette assembly awnings or stationary rolls may be utilized according to non-limiting alternative embodiments.

Figure 6:
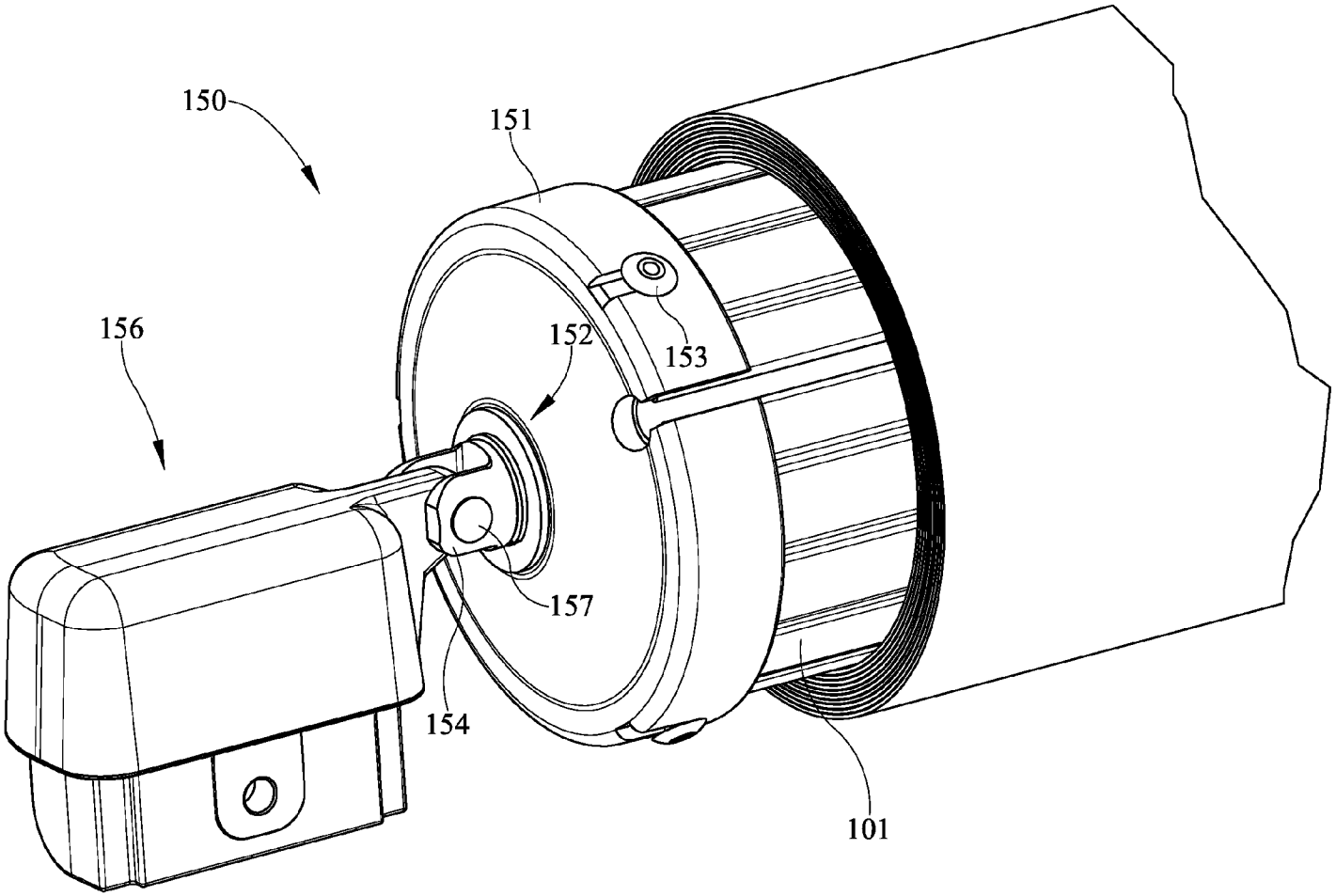

Referring now to FIG. 6 at the opposite end of the roller tube assembly 100 is an opposite end cap assembly 150. According to some embodiments, the assembly 150 comprises a rotary shaft 152 attached through an end cap 151. The end cap 151 is secured to the shifting tube 101 with fasteners 153. The shaft 152 is constrained axially by geometry on an interior of the end cap 151. The shaft 152 is journaled allowing the roller tube 101 and cap 151 to rotate freely about its own axis. At the opposite end of the shaft 152 is a gimbal 154 which is connected by pin 157 to the bracket 156. With the shaft 152 journaled to the end cap 151, the end cap 151 can rotate while the bracket 156 is fixed to the hardware arm assembly 202 (FIG. 2). The assembly 150 facilitates subsequent tilt of the shifting tube 101 with respect to the arm assembly 202. According to some embodiments, this represents tilt about an axis perpendicular to the mounting surface when the awning is in the stowed position but other embodiments might prefer axis orientation that is not perpendicular to the mounting surface. This end cap assembly 150 is attached to the arm 220 of this end hardware 202 with fasteners, not shown, by the installer.

With regard now to installation, the arms 200, 202 are fastened to the roll tube assembly 100 and the fabric 102 is inserted into the receiving channel of tube 101. The assembly 20 is moved to the desired location on the vehicle or structure. The inner arms 230 and outer rafters 260 are fastened to the vehicle, operate a few times and then when stowed, the fabric is secured from sliding in the receiving channel.

In operation, to open, a user releases rafter latches, if applicable. The latches are not necessary to secure hardware but may be included on conventional style hardware to avoid rattle sounds generated by vibration from vehicle motion or by winds when stowed. Next, a crank handle is inserted into receiver 112 of drive mechanism 110. This may be manually operated or may be, for example, operated by a driver, such as a battery powered drill for automated usage. In either the automated or manual modes of operation, the transmission receiver 112 is turned in the 'deploy' direction until the desired extension is attained. Next, the rafters 250 may be set up if applicable. Next, arms 210 are extended or set up to upright position if desired and applicable. To close, reverse the opening sequence. Note that additional steps might be required for varying hardware structures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A shifting roll awning assembly, comprising:

a roller tube having a first end and a second end, said roller tube having a canopy rolled thereon;

a first cap at one of said ends of said roller tube, said first cap having a portion of a universal joint formed thereon;

a second cap at the other of said ends which is journaled to a rotary shaft allowing rotation of said roller tube relative to said rotary shaft;

said universal joint also connected to a drive shaft at said one of said first end and said second end;

a drive assembly operably connected to said drive shaft to drive said first cap, said second cap and said roller tube about said rotary shaft, said drive assembly providing for an input in a first direction and an output in a second direction at an angle to said first direction; and, a receiver operably connected to said input of said drive assembly, said receiver having an input to accept a removable torque input device.

2. The shifting roll awning assembly of claim 1, said joint allowing off angle operation between said shaft and said drive assembly.

3. The shifting roll awning assembly of claim 1, said drive assembly being a gear drive.

4. The shifting roll awning assembly of claim 3, said drive assembly being a right angle gear drive.

5. The shifting roll awning assembly of claim 1 wherein said input to said drive assembly is one of manual or automated.

6. The shifting roll awning assembly of claim 1, said joint including at least one pad.

7. The shifting roll awning assembly of claim 1, said receiver being a cone shaped receiver.

8. The shifting roll awning assembly of claim 7 further comprising an input drive which engages said cone shaped receiver.

9. The shifting roll awning assembly of claim 8, said input drive being T-shaped.

10. The shifting roll awning assembly of claim 8, said input drive having a shear pin.

11. The shifting roll awning assembly of claim 1 further comprising a cover for said drive shaft.

12. A shifting roll awning assembly, comprising:

a roller of generally cylindrical shape having a first end and second end, and a canopy rolled about said roller;

one of said first and second ends having a first end cap and a journaled shaft extending through said first end cap for operable connection to a bracket;

the other of said first and second ends of said roller having a second end cap and gimbal extending from said second end cap;

a universal joint defined in part by said gimbal and operably connected to a drive shaft;

a drive mechanism connected to said drive shaft and turning said drive shaft, said roller and said end caps relative to said journaled shaft;

said drive mechanism having an input oriented in a first direction and an output oriented in a second direction, at an angle to said first direction; and, a receiver connected to said drive mechanism, said receiver having an input configured to receive a removable manual torque input device or a removable automated torque input device.

13. The shifting roll awning assembly of claim 12, said drive mechanism being a right angle drive.

14. The shifting roll awning assembly of claim 12, said drive shaft passing through a second bracket.

15. The shifting roll awning assembly of claim 12, said universal joint having pads disposed between gimbals and a linkage.

16. The shifting roll awning assembly of claim 12, said drive having a receiver.

17. The shifting roll awning assembly of claim 12, said receiver being at least one of cone shaped or bell shaped.

18. A shifting roll awning assembly, comprising:

a roller having a generally cylindrical shape with a first end and a second end, a canopy which may be wrapped about said roller or extend from said roller;

a first end cap and a second end cap at said first end and said second end respectively;

a drive mechanism located at one of said first end and said second end;

said drive mechanism receiving a drive shaft which causes rotation of said roller;

said roller having one of said first and second end caps adjacent to said drive mechanism and connected to said drive shaft by a universal joint;

the other of said first and second end caps being journaled to allow rotation relative to a rotary shaft;

a receiver connected to said drive mechanism, said receiver having an input which receives a removable torque input device.

19. The shifting roll awning assembly of claim 18, said drive mechanism receiving a drive input.

20. The shifting roll awning assembly of claim 19, said drive input having a shear pin.

21. The shifting roll awning assembly of claim 18 further comprising a cover disposed over said drive shaft.

* * * * *